US010736365B2

(12) United States Patent
Lin et al.

(10) Patent No.: US 10,736,365 B2
(45) Date of Patent: Aug. 11, 2020

(54) INTELLIGENT BRA

(71) Applicant: Microjet Technology Co., Ltd., Hsinchu (TW)

(72) Inventors: Ching-Sung Lin, Hsinchu (TW); Shih-Chang Chen, Hsinchu (TW); Li-Pang Mo, Hsinchu (TW); Chang-Yen Tsai, Hsinchu (TW); Chi-Feng Huang, Hsinchu (TW); Yung-Lung Han, Hsinchu (TW)

(73) Assignee: MICROJET TECHNOLOGY CO., LTD., Hsinchu (TW)

( * ) Notice: Subject to any disclaimer, the term of this patent is extended or adjusted under 35 U.S.C. 154(b) by 169 days.

(21) Appl. No.: 16/023,850

(22) Filed: Jun. 29, 2018

(65) Prior Publication Data

US 2019/0000153 A1 Jan. 3, 2019

(30) Foreign Application Priority Data

Jul. 3, 2017 (TW) ..... 106122227 A

(51) Int. Cl.
*A41C 3/00* (2006.01)
*A41C 3/10* (2006.01)
*F04B 45/047* (2006.01)

(52) U.S. Cl.
CPC ..... *A41C 3/105* (2013.01); *F04B 45/047* (2013.01)

(58) Field of Classification Search
CPC ..... A41C 3/105; F04B 45/047
USPC ..... 450/28, 36, 38
See application file for complete search history.

(56) References Cited

U.S. PATENT DOCUMENTS 5,347,656 A * 9/1994 Fabritz ..... A41C 3/105 2/67
6,921,316 B1 * 7/2005 Jian ..... A41C 3/105 450/38
8,047,891 B1 11/2011 Albritton
9,468,236 B1 10/2016 Sherry

FOREIGN PATENT DOCUMENTS

| | | | |
|---|---|---|---|
| CN | 105484982 | A | 4/2016 |
| TW | M252282 | U | 12/2004 |
| TW | M421712 | U1 | 2/2012 |
| TW | M473075 | U | 3/2014 |
| TW | 204273282 | U | 4/2015 |
| TW | 204426728 | U | 7/2015 |
| TW | 206251546 | U | 6/2017 |

* cited by examiner

*Primary Examiner* — Timothy K Trieu
(74) *Attorney, Agent, or Firm* — Birch, Stewart, Kolasch & Birch, LLP

(57) ABSTRACT

An intelligent bra includes a main body and an air pump. The main body includes a connection base connected with a cup set, two back bands and two fixing elements. The cup set includes a first cup, a second cup and a central part defined between the first cup and the second cup. The cup set includes an outer layer, an inner layer and an air bag layer. The air bag layer is disposed between the outer layer and the inner layer. A connection end of an airflow channel of the air bag layer is disposed on the central part. The two back bands are respectively connected with the connection base. The two fixing elements are disposed on the lateral sides of the two back bands, respectively. The air pump is detachably connected with the connection end, so as to adjust an inner pressure of the air bag layer.

8 Claims, 10 Drawing Sheets

INTELLIGENT BRA

FIELD OF THE INVENTION

The present disclosure relates to a bra, and more particularly to an inflatable intelligent bra.

BACKGROUND OF THE INVENTION

Bras are indispensable products for modern women, in which the stability of supporting the breasts is a key point of women's consideration when purchasing the bras. If the stability is poor, the bra may slip and dislocate easily with the wearer's body movement and it will make the wearer feel insecure and uncomfortable. The wearer also needs to readjust the position of the bra frequently, which causes inconvenience to the wearer.

On the other hand, most modern women wear bras for a long period of time in daily lives, which makes the comfort of bras also important to the consideration of the female consumers. Another advantage of wearing a bra is that the bra can push the breasts up and together to make the better shape of the breasts, and help preventing the breasts from expanding and sagging. So modern women also pay considerable attention to the push-up-and-together effect of the bras.

A conventional bra commonly utilizes the underwire to support the breasts, in which the underwire is made of hard steel and fastened to the lower edges of the cups. The metal underwire provides sufficient strength and supporting force to stably support the breasts and achieve the push-up-and-together effect for the breasts. However, the steel underwire is easy to be deformed. Moreover, it is rigid and has little elasticity. As a result, since the underwire is touching a woman's chest and close to her breasts every day, it would cause the woman an uncomfortable and oppression feeling.

In view of this, there are various bras designed to have no metal underwire in the current market. However, since there is no underwire to lift and push up the breasts, these types of bras have poor efficacy of pushing the breasts up and together. In other words, the non-underwire bras fail to maintain the shape of the breasts and are not optimal products to the female consumers.

Therefore, there is a need of providing an intelligent bra having no metal underwire but providing great support to the breasts and having ability to push the breasts up and together as well as the underwire bra does, so as to solve the drawbacks in prior arts.

SUMMARY OF THE INVENTION

An object of the present disclosure provides an intelligent bra to solve the problem that the bra with metal underwire has sufficient support to the breasts but is not comfortable, and the bra with no metal underwire is comfortable but has insufficient support to the breasts.

In accordance with an aspect of the present disclosure, there is provided an intelligent bra, which includes a main body and an air pump. The main body includes a connection base, a cup set, two back bands and two fixing elements. The cup set is connected with the connection base and includes a first cup and a second cup correspondingly disposed with each other. A central part is defined between the first cup and the second cup. The cup set includes an outer layer, an inner layer and an air bag layer, and the air bag layer is disposed between and covered within the outer layer and the inner layer. The air bag layer includes an airflow channel and the airflow channel includes a connection end disposed on the center part. The two back bands are connected with two lateral sides of the connection base, respectively. The two fixing elements are disposed by the two straps, respectively. The air pump is detachably connected with the connection end of the airflow channel of the air bag layer, so as to introduce air from an external environment into the connection end of the airflow channel of the air bag layer to adjust an inner pressure of the air bag. The air pump is allowed to inflate or deflate the air bag layer of the cup set, so as to the inner pressure of the air bay layer.

The above contents of the present disclosure will become more readily apparent to those ordinarily skilled in the art after reviewing the following detailed description and accompanying drawings, in which:

DETAILED DESCRIPTION OF THE PREFERRED EMBODIMENT

The present disclosure will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1A:
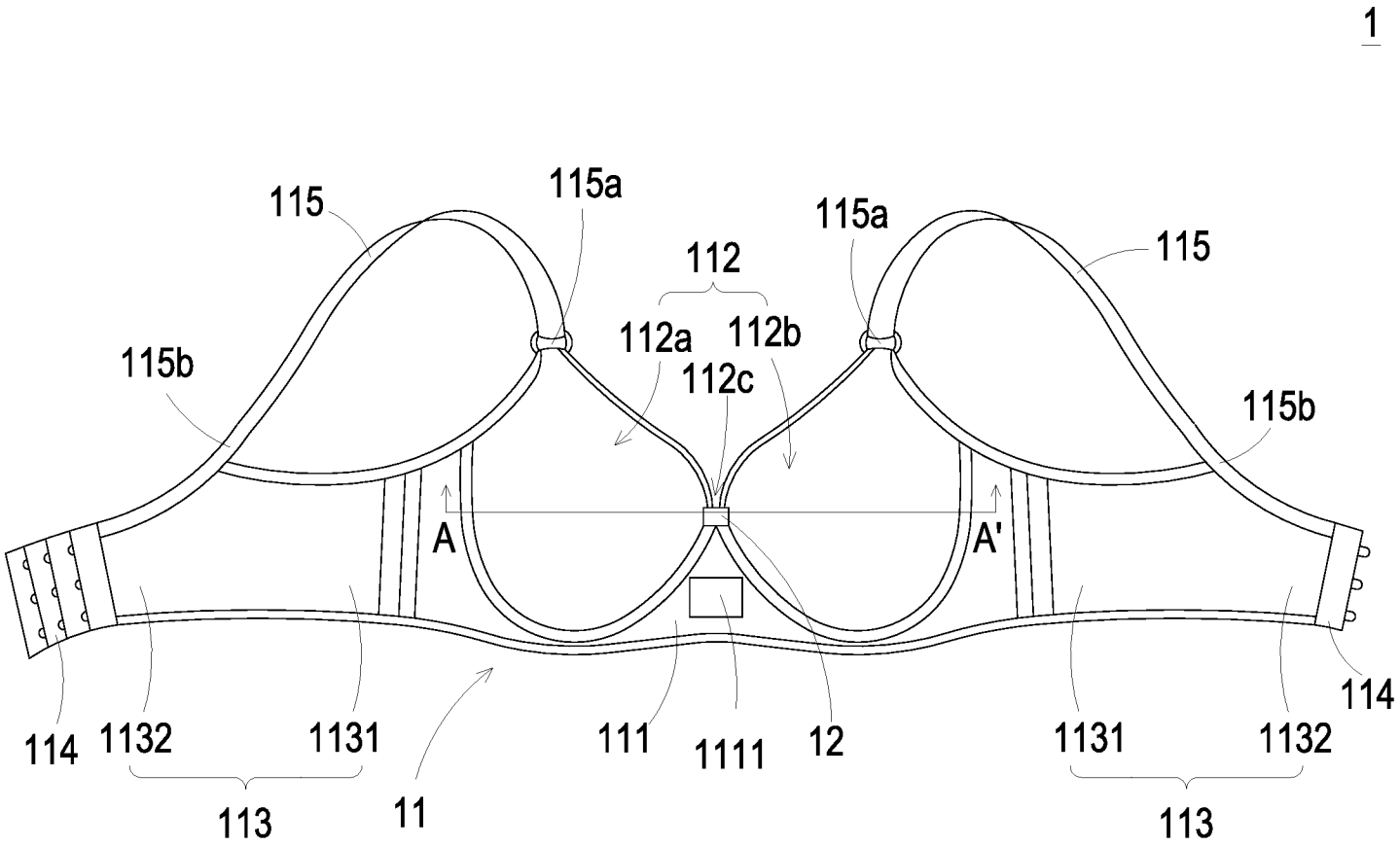
FIG. 1A is a front view illustrating a intelligent bra according to an embodiment of the present disclosure.
Figure 1B:
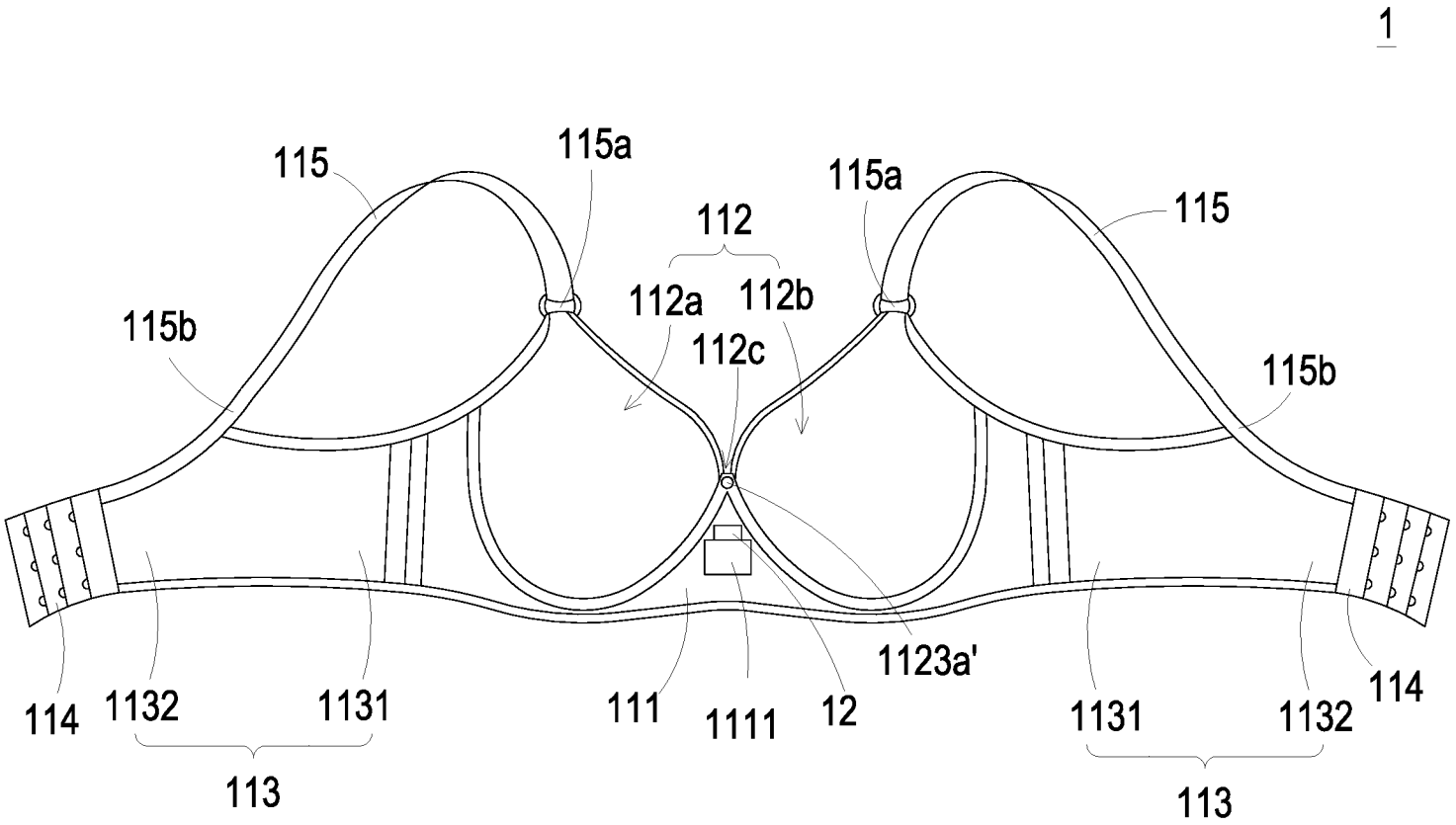
FIG. 1B is a front view illustrating the intelligent bra while the air pump is detached.
Figure 2:
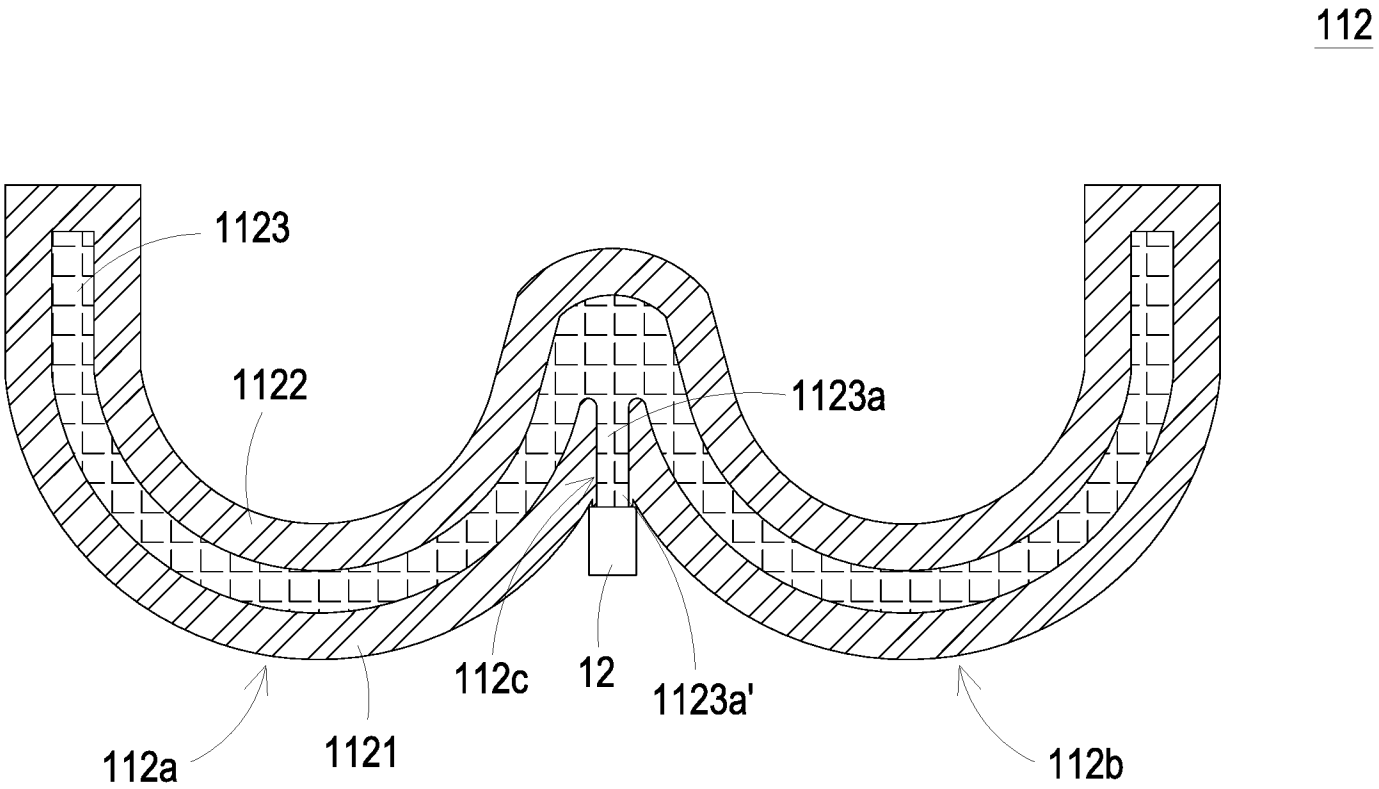
FIG. 2 is a cross-sectional view illustrating the intelligent bra and taken along line A-A' of FIG. 1A.

Please refer to FIGS. 1A, 1B and FIG. 2. The present disclosure provides an intelligent bra 1, which includes at least one main body 11, at least one cup set 112, at least one first cup 112*a*, at least one second cup 112*b*, at least one central part 112*c*, an outer layer 1121, at least one inner layer 1122, at least one air bag layer 1123, at least one airflow channel 1123*a*, at least one connection end 1123*a*', and at least one air pump 12. The numbers of the main body 11, the cup set 112, the first cup 112*a*, the second cup 112*b*, the central part 112*c*, the outer layer 1121, the inner layer 1122, the air bag layer 1123, the airflow channel 1123*a*, the connection end 1123*a*' and the air pump 12 are exemplified by one for each respectively in the following embodiments but not limited thereto. It is noted that each of the main body 11, the cup set 112, the first cup 112*a*, the second cup 112*b*, the central part 112*c*, the outer layer 1121, the inner layer 1122, the air bag layer 1123, the airflow channel 1123*a*, the connection end 1123*a*' and the air pump 12 can also be provided in plural numbers.

Please refer to FIGS. 1A and 1B. FIG. 1A is a front view illustrating an intelligent bra according to an embodiment of the present disclosure. FIG. 1B is a front view illustrating the intelligent bra while the air pump is detached. The intelligent bra 1 of the present disclosure includes a main body 11 and an air pump 12. The main body 11 includes a connection base 111, a cup set 112, two back bands 113 and two fixing elements 114. The connection base 111 is a gore worked as a connection component, which is configured to carry the cup set 112 and connected with the two back bands 113. The cup set 112 includes a first cup 112, a second cup 112*b* and a central part 112*c* located therebetween. The first cup 112 and the second cup 112*b* are symmetrically disposed with respect to the central part 112*c*. Each back band 113 includes a connecting portion 1131 and an end portion 1132. The connecting portions 1131 of the two back bands 113 are connected with two opposite lateral sides of the connection base 111, respectively. The connection base 111 and the two back bands 113 may be made by means of tailoring the soft cloth, and the cup set 112 may be made of one or more layers of cloth material.

Moreover, the main body 11 includes two fixing elements 114 disposed on the end portions 1132 of the two back bands 113, respectively. The two fixing elements 113 are configured to engage and connect with each other to connect the end portions 1132 of the two back bands 113 with each other. The two fixing elements 114 may be a hook-and-eye closure system hooks, but not limited thereto. In some embodiments, the two fixing elements 114 can also be fixing structures such as two magnets capable of attracting with each other, buttons, hooks and eyelets and so on. With the connection base 111, the cup set 112, the two back bands 113 and the two fixing elements 114 described above, the structure of the main body 11 of the present disclosure can be constituted. The two back bands 113 can be connected with each other by the two fixing elements 114 to form a structure surrounding the user's body so that the intelligent bra 1 is worn.

Please refer to FIGS. 1A, 1B and 2, in which FIG. 2 is a cross-sectional view illustrating the intelligent bra and taken along line A-A' of FIG. 1A. As shown in FIG. 2, the cup set 112 of the main body 11 is formed by joining two fabric structures which may be sewed together. Furthermore, the cross-sectional structure of the cup set 112 includes an outer layer 1121, an inner layer 1122 and an air bag layer 1123. The air bag layer 1123 is disposed between the outer layer 1121 and the inner layer 1122 to be covered by both the outer layer 1121 and the inner layer 1122. The outer layer 1121 and the inner layer 1122 can be made of two different fabric materials, but not limited thereto. The fabric materials can be varied according to the practical requirements. As to the air bag layer 1123, it is sandwiched between the outer surface layer 1121 and the inner surface layer 1122, and the appearance and the arrangement of the air bag layer 1123 can be varied according to the practical requirements. For example, the air bag layer 1123 may be in the form of an arc of a half moon, and is correspondingly disposed at the lower edge of the first cup 112*a* and the second cup 112*b*, respectively. The size of the air bag layer 1123 is approximately ⅓ cup size under this circumstance, but not limited thereto. In some other embodiments, the air bag layer 1123 may be in form of ½ cup and covers half of the first cup 112*a* and half of the second cup 112*b*, respectively, but not limited thereto. In further other embodiments, the air bag layer 1123 may be in form of full cup and covers the first cup 112*a* and the second cup 112*b* completely. Form the above description, it can be seen that the type, the arrangement and the covering range of the air bag layer 1123 is adjustable according to the practical requirements, and is not limited to the foregoing embodiments.

In addition, as shown in FIG. 2, in the embodiment, the air bag layer 1123 further includes an airflow channel 1123*a* in communication with the air bag layer 1123. The airflow channel 1123*a* can be disposed within the air bag layer 1123. Further as shown in FIG. 2, the connection end 1123*a*' of the airflow channel 1123*a* can be extended to the central part 112*c* of the cup set 112 and runs through the outer layer 1121 of the cup set 112, so as to allow an external device (for example, an air pump 12) to connect with the airflow channel 1123*a*, but the arrangement is not limited thereto. In some embodiments, the connection end 1123*a*' of the airflow channel 1123*a* can be disposed at any position of the cup set 112, for example, a lateral edge of the first cup 112*a* or the second cup 112*b*, but not limited thereto. The arrangement of the connection end 1123*a*' can be adjustable according to the position of the external device to be connected with. In the embodiment, the air pump 12 is correspondingly disposed at the central part 112*c* of the cup set 112 and detachably connected with the connection end 1123*a*' of the airflow channel 1123*a* of the air bag layer 1123, but not limited thereto. In some embodiments, the air pump 12 can be a fixed structure and similarly connected with the connection end 1123*a*' of the air flow channel 1123*a*, but the arrangement is not limited thereto. Thus, the air pump 12 is allowed to suck in or vent the air through the connection end 1123*a*' of the airflow channel 1123*a*, by which the air bag layer 1123 is inflated or deflated and an inner pressure of the air bag layer 1123 is adjusted. In this way, by controlling the air pump 12, the user can adjust the air bag layer 1123 of the cup set 112 to adjust the hardness, the appearance and the support strength of the first cup 112*a* and the second cup 112*b*, according to the shape of the breasts. Therefore, stable support and lift are provided and the pushing-up-and-together effect of the intelligent bra 1 is achieved.

Please refer to FIGS. 1A and 1B. As shown in FIGS. 1A and 1B, the connection base 111 further includes a least one accommodation part 1111. In the embodiment, the accommodation part 1111 is corresponding disposed under the central part 112*c* of the cup set 112, but not limited thereto. In some embodiments, the accommodation part 1111 can be disposed at any position of the main body 11, for example, disposing two accommodation parts 1111 at the end portions 1132 of the back bands 113, or the lateral sides of the connection base 111, respectively. The accommodation part 1111 can be arranged at any location on the intelligent bra 1 where is avoiding from affecting the user's wear experience. The accommodating part 1111 is mainly used to accommodate the air pump 12 while the user has finished using the air pump 12 and detached the air pump 12. Thus, the detached air pump 12 can be conveniently accommodated within the accommodating part 1111. There is no need to find an additional accommodation space for storage, and the possibility of losing the air pump 12 can be reduced.

In the embodiment, the intelligent bra 1 further includes two straps 115 each of which is connected with the cup set 112 and each back band 113, but not limited thereto. In some embodiments, the intelligent bra 1 of the present disclosure can be a no-strap type or with detachable straps. As shown in FIGS. 1A and 1B, in the embodiment, each of two straps 115 includes a first end 115*a* and a second end 115*b*. The first ends 115*a* of the two straps 115 are connected to top edges of the first cup 112*a* and the second cup 112*b*, respectively, and the second ends 115*b* of the two straps 115 are connected to the two back bands 113, respectively, so as to assist to support the intelligent bra 1. Thus, the user can wear the intelligent bra 1 of the present disclosure on the user's body firmly with the assistance of the two straps 115.

Figure 3:
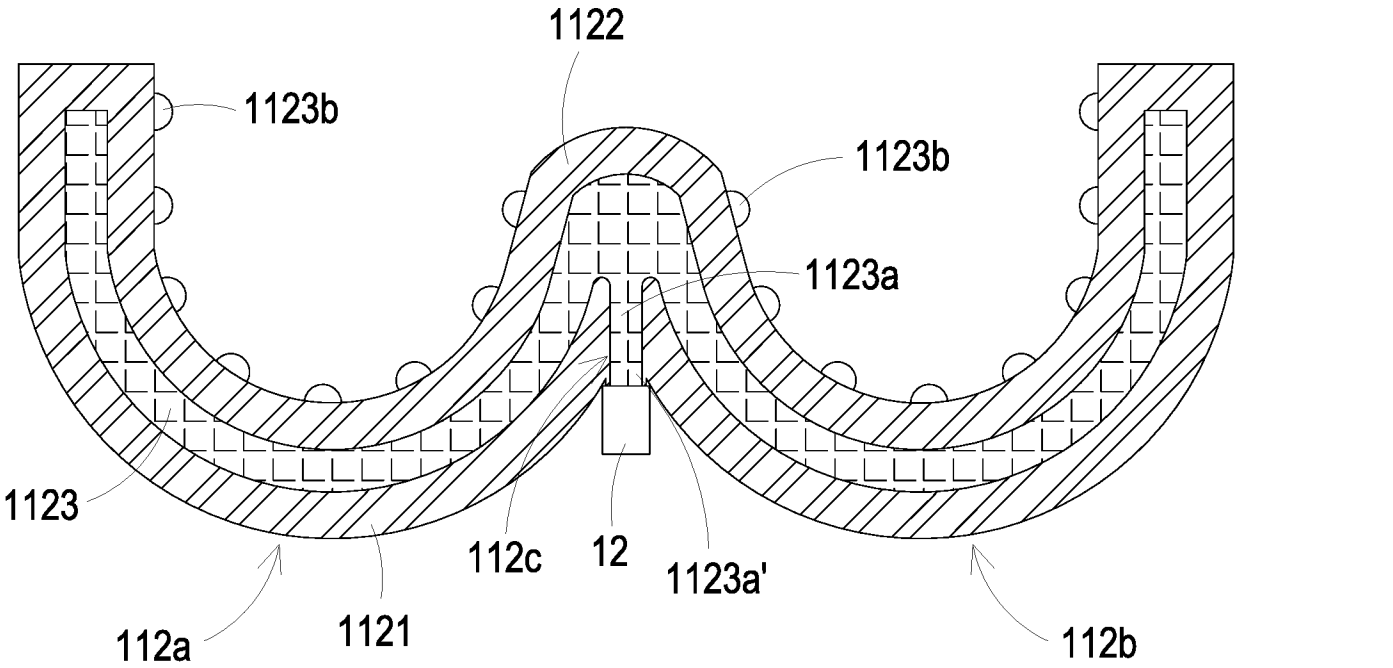
FIG. 3 is a cross-sectional view illustrating a intelligent bra according to another embodiment of the present disclosure.

Please refer to FIG. 3. FIG. 3 is a cross-sectional view illustrating an intelligent bra according to another embodiment of the present disclosure. In the embodiment, the cup set 112 of the intelligent bra 1 includes an outer layer 1121, an inner layer 1122 and an air bag layer 1123 similar to those of the embodiment of FIG. 2 so are not redundantly described herein. In the embodiment, the intelligent bra 1 further includes plural protrusions 1123*b* disposed on the inner layer 1122 of the cup set 112 of the main body 11 and distributed over the first cup 112*a* and the second cup 112*b*. Furthermore, the plural protrusions 1123*b* may be in communication with the air bag layer 1123, so that the touch feeling of the plural protrusions 1123*b* is adjustable since the inner pressure of the air bag layer 1123 is adjustable through inflation and deflation by the air pump 12. For example, the plural protrusions 1123*b* can be made harder by increasing the inner pressure of the air bag layer 1123, thereby being able to massage the user's breasts. In other embodiments, each of the plural protrusions 1123*b* can be connected with an additional airflow channel (not shown) to be separated from and not in communication with the air bag layer 1123. Namely, independent adjustment is allowed for the inner pressure of the air bag layer 1123 and the hardness of the plural protrusions 1123*b*, so as to provide the user with more diversified choices.

Figure 4A:
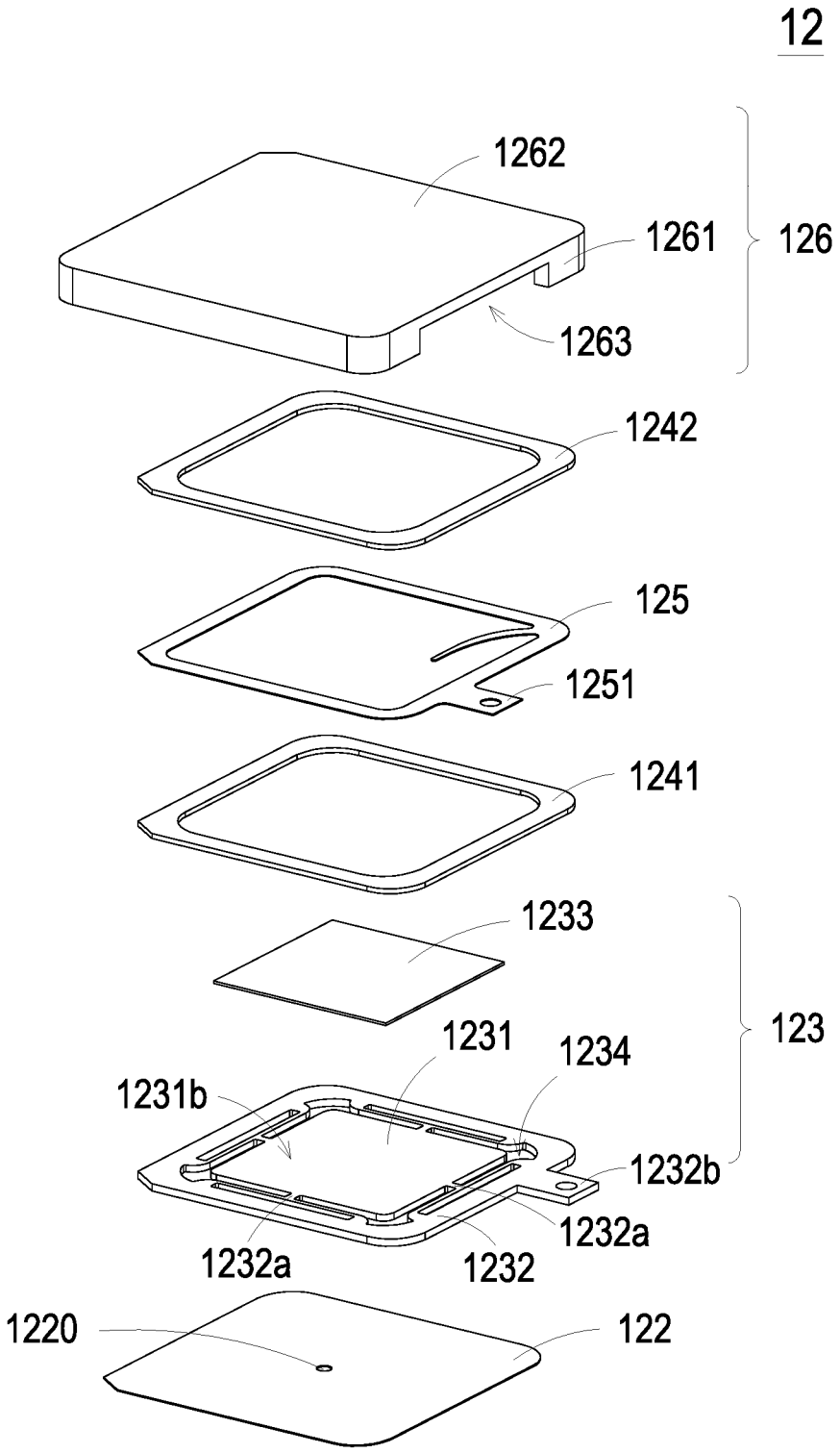
FIG. 4A is a front exploded view illustrating the air pump according to an embodiment of the present disclosure.
Figure 4B:
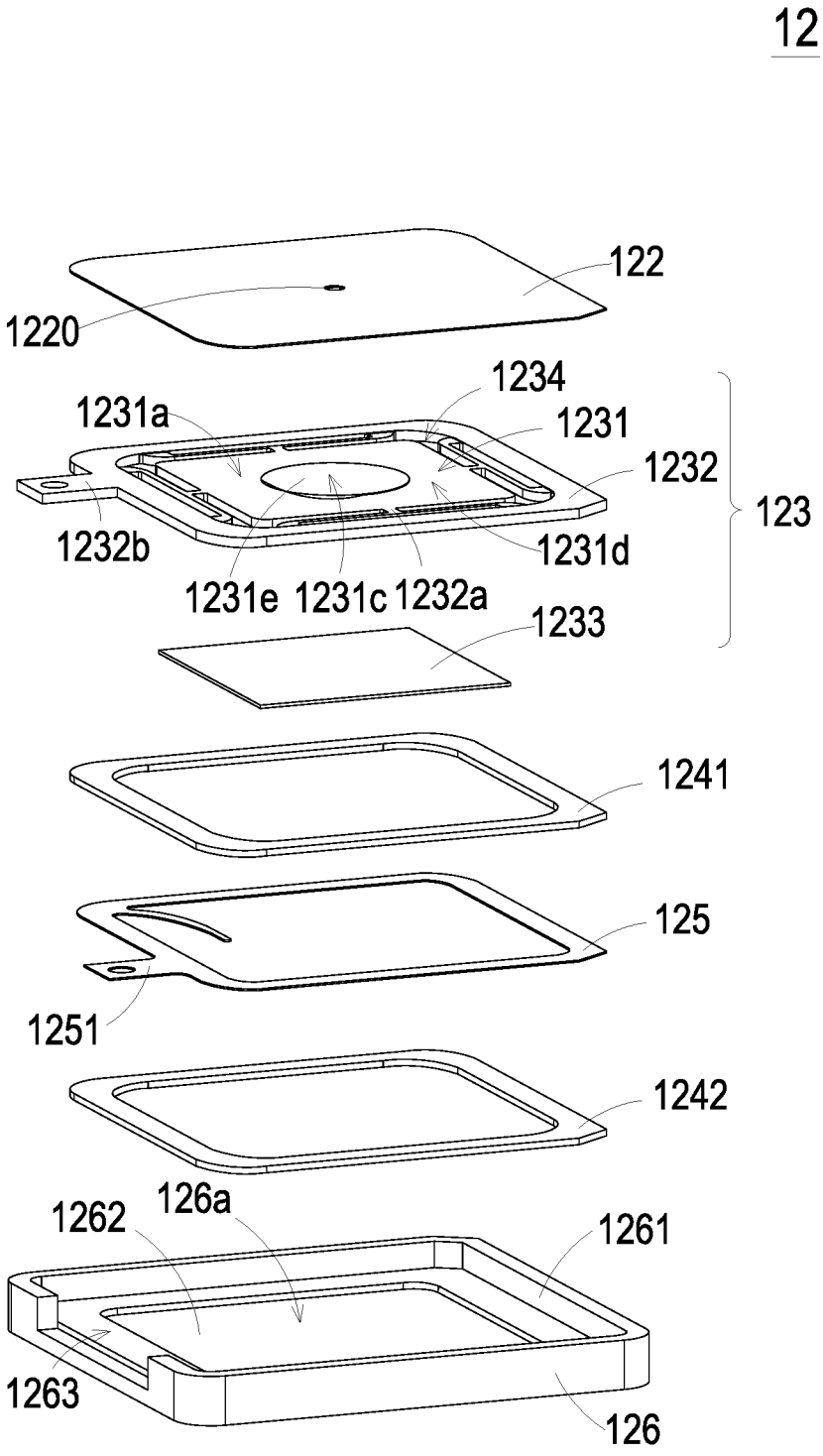
FIG. 4B is a rear exploded view illustrating the air pump according to the embodiment of the present disclosure.

Please refer to FIGS. 4A and 4B. FIG. 4A is a front exploded view illustrating the air pump according to an embodiment of the present disclosure. FIG. 4B is a rear exploded view illustrating the air pump according to the embodiment of the present disclosure. The intelligent bra 1 (shown in FIGS. 1A, 1B and 2) of the present disclosure utilizes the air pump 12 to introduce the air into the air bag layer 1123 of the intelligent bra 1, but not limited thereto. In the embodiment, the air pump 12 is a piezoelectric air pump which is detachable and in communication with the airflow channel 1123*a* (shown in FIG. 2). Being guided by the air pump 12, the air is introduced from the external environment into the airflow channel 1123*a* and further transferred into the air bag layer 1123 (shown in FIG. 2) though the airflow channel 1123*a*, but not limited thereto. In some embodiments, the air pump 12 can also be an embedded air pump.

In the embodiment, the air pump 12 is a piezoelectric air pump for driving the flow of the air. As shown in FIGS. 4A and 4B, the air pump 12 of the present disclosure includes a resonance plate 122, a piezoelectric actuator 123 and a cover plate 126. The resonance plate 122 is disposed spatially corresponding to the piezoelectric actuator 123. The resonance plate 122 includes a central aperture 1220 disposed on the central area of the resonance plate 122, but not limited thereto. The piezoelectric actuator 123 includes a suspension plate 1231, an outer frame 1232 and a piezoelectric element 1233. The suspension plate 1231 can be but not limited to a square suspension plate. The suspension plate 1231 includes a central portion 1231*c* and a peripheral portion 1231*d*. When a voltage is applied to the piezoelectric element 1233, the suspension plate 1231 is subjected to a bending vibration from the central portion 1231*c* to the peripheral portion 1231*d*. The outer frame 1232 is arranged outside around the suspension plate 1231 and includes at least one bracket 1232*a* and a conducting pin 1232*b*, but not limited thereto. Each bracket 1232*a* includes two ends connected between the suspension plate 1231 and the outer frame 1232 for providing an elastically supporting. The conducting pin 1232*b* protrudes outwardly from the outer frame 1232 for an electrically external connection. The piezoelectric element 1233 is attached to a second surface 1231*b* of the suspension plate 1231. The length of a side of the piezoelectric element 1233 is equal to or less than the length of a side of the suspension plate 1231, so as to receive the applied voltage and generate the deformation to drive the bending vibration of the suspension plate 1231. The cover plate 126 includes at least one sidewall 1261, a bottom plate 1262 and an opening portion 1263. The sidewalls 1261 protrudes vertically from a periphery of the bottom plate 1262, so as to define an accommodation space 126*a* by the sidewalls 1261 and the bottom plate 1262 collaboratively. The resonance plate 122 and the piezoelectric actuator 123 are accommodated within the accommodation space 126*a*. The opening portion 1263 is disposed on the sidewall 1261 so that the conducting pin 1232*b* of the outer frame 1232 passes through the opening portion 1263 and protrudes out of the cover plate 126. It's beneficial for the conducting pin 1232*b* to connect with an external power, but the present disclosure is not limited thereto.

In the embodiment, the air pump 12 of the present disclosure further includes a first insulation plate 1241, a second insulation plate 1242 and a conducting plate 125, but not limited thereto. The first insulation plate 1241 and the second insulation plate 1242 are disposed on the top and the bottom of the conducting plate 125, respectively, and have the profiles substantially matching the profile of the outer frame 1232 of the piezoelectric actuator 123. The first insulation plate 1241 and the second insulation plate 1242 can be made of an insulating material, for example but not limited to a plastic material, for providing insulating efficacy. The conducting plate 125 is made of an electrically conductive material, for example but not limited to a metallic material, for providing electrically conducting efficacy. The conducting plate 125 has its profile substantially matching the profile of the outer frame 1232 of the piezoelectric actuator 123, but the present disclosure is not limited thereto. Moreover, the conducting plate 125 may have a conducting pin 1251 for an electrically external conduction. The conducting pin 1251 is similar to the conducting pin 1232*b* of the outer frame 1232 to pass through the opening portion 1263 and protrude out of the cover plate 126 for electrically connecting to an external power, but not limited thereto.

Figure 5A:
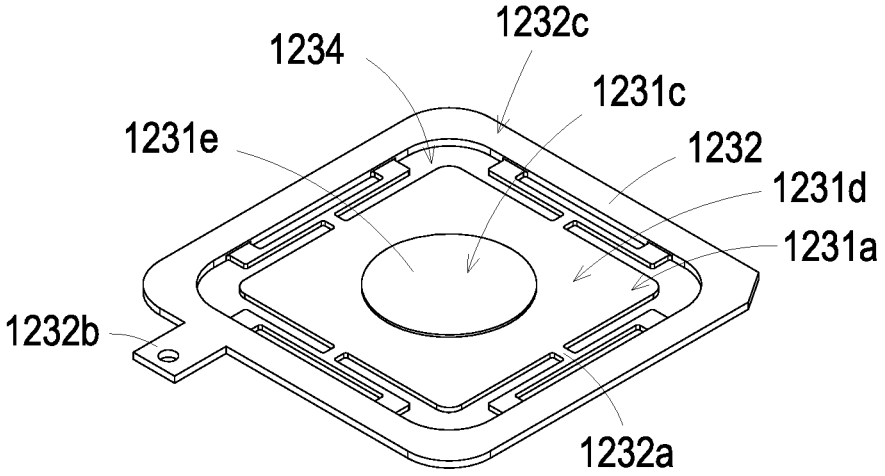
FIG. 5A is a front view illustrating the piezoelectric actuator of FIGS. 4A and 4B.
Figure 5B:
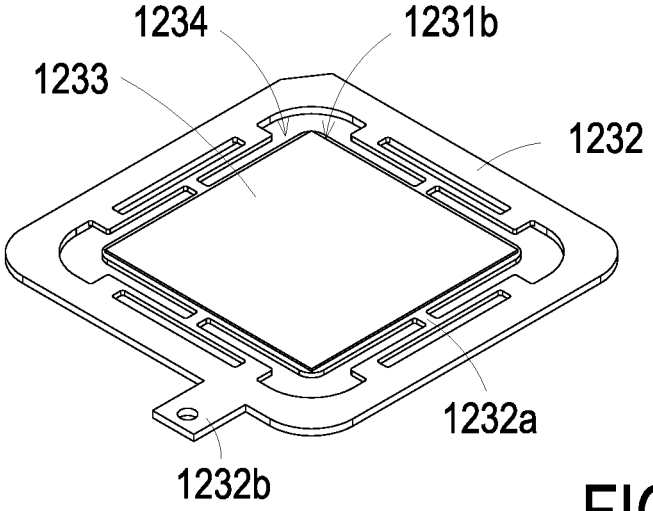
FIG. 5B is a rear view illustrating the piezoelectric actuator of FIGS. 4A and 4B.
Figure 5C:
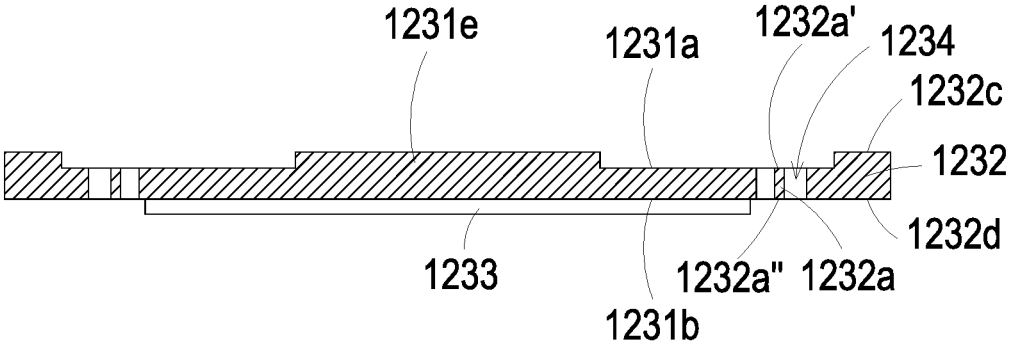
FIG. 5C is a cross-sectional view illustrating the piezoelectric actuator of FIGS. 4A and 4B.

Please refer to FIGS. 5A to 5C. FIG. 5A is a front view illustrating the piezoelectric actuator of FIGS. 4A and 4B. FIG. 5B is a rear view illustrating the piezoelectric actuator of FIGS. 4A and 4B. FIG. 5C is a cross-sectional view illustrating the piezoelectric actuator of FIGS. 4A and 4B. As shown in FIGS. 5A to 5C, in the embodiment, the suspension plate 1231 has a stepped structure. The suspension plate 1231 further includes a bulge 1231*e* disposed on the central portion 1231*c* of the first surface 1231*a*. The bulge 1231*e* can be a circular protrusion structure, but not limited thereto. In some embodiment, the suspension plate 1231 can be a double-sided planar square plate. Further as shown in FIG. 5C, the bulge 1231*e* of the suspension plate 1231 and the first surface 1232*c* of the outer frame 1232 are coplanar, and the first surface 1231*a* of the suspension plate 1231 and the first surface 1232*a*' of the bracket 1232*a* are coplanar. In addition, the bulge 1231*e* of the suspension plate 1231 and the first surface 1232*c* of the outer frame 1232 have a specific depth relative to the first surface 1231*a* of the suspension plate 1231 and the first surface 1232*a*' of the bracket 1232*a*. As shown in FIGS. 5B and 5C, the second surface 1231*b* of the suspension plate 1231, the second surface 1232*d* of the outer frame 1232 and the second surface 1232*a*" of the bracket 1232*a* are formed as a flat coplanar structure. The piezoelectric element 1233 is attached to the flat second surface 1231*b* of the suspension plate 1231. In some embodiments, the suspension plate 1231 can be a double-sided planar square plate, but not limited thereto. It is adjustable according to the practical requirements. In some embodiment, the suspension plate 1231, the outer frame 1232 and the bracket 1232*a* can be formed as an integrated structure, and made of a metal plate, for example but not limited to a stainless steel plate. Moreover, in the embodiment, the air pump 12 further includes at least one interspace 1234 disposed among the suspension plate 1231, the outer frame 1232 and the bracket 1232*a* for the air passing therethrough.

Figure 6:
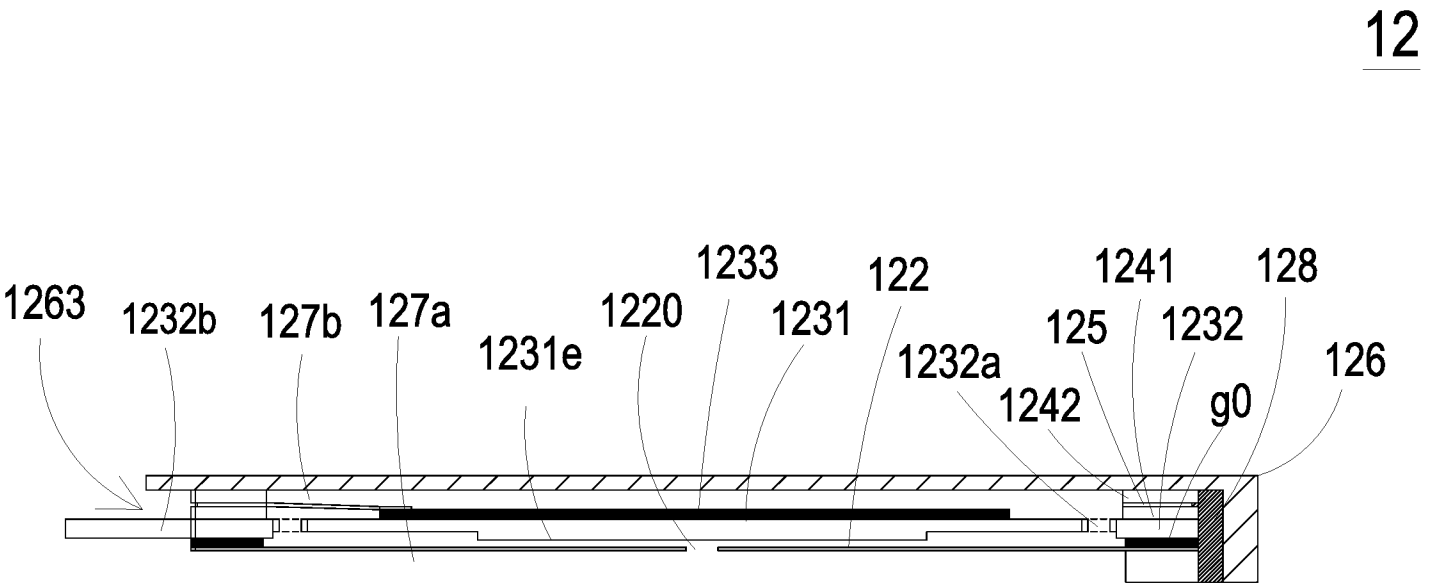
FIG. 6 is a cross-sectional view illustrating the air pump of FIGS. 4A and 4B.

Please refer to FIG. 6. FIG. 6 is a cross-sectional view illustrating the air pump of FIGS. 4A and 4B. As shown in FIG. 6, the air pump 12 includes the cover plate 126, the second insulation plate 1242, the conducting plate 125, the first insulation plate 1241, the piezoelectric actuator 123 and the resonance plate 122 stacked on each other from top to bottom sequentially. After the piezoelectric actuator 123, the first insulation plate 1241, the conducting plate 125 and the second insulation plate 1242 are assembled and stacked, an adhesive 128 is coated around the periphery of the assembled structure to accomplish sealing. The assembled air pump 12 is a quadrilateral structure, but not limited thereto. The shape can be adjustable according to the practical requirements. In addition, in the embodiment, the conducting pin 1251 (shown in FIG. 4A) of the conducting plate 125 and the conducting pin 1232*b* (shown in FIG. 5A) of the piezoelectric actuator 123 protrude out of the cover plate 126 merely for electrically connecting with an external power, but not limited thereto. A first chamber 127*b* is formed between the cover plate 126 and the resonance plate 122 in the assembled air pump 12.

In the embodiment, the air pump 12 of the present disclosure includes a gap g0 disposed between the resonance plate 122 and the piezoelectric actuator 123, and a conductive material, for example but not limited to a conductive adhesive, is filled into the gap g0. Consequently, the depth of the gap g0 between the resonance plate 122 and the bulge 1231*e* of the suspension plate 1231 of the piezoelectric actuator 123 is maintained, which is capable of guiding the air to flow more quickly. Moreover, due to the proper distance between the bulge 1231*e* of the suspension plate 1231 and the resonance plate 122, the contact interference is reduced and thus the generated noise is largely reduced. In other embodiments, by adding the height of the outer frame 1232 of the piezoelectric actuator 123, a gap is added when the outer frame 1232 is assembled with the resonance plate 122, but the present disclosure is not limited thereto. Thus, when the piezoelectric actuator 123 is driven to converge the air, the air is transferred from the opening portion 1263 of the cover plate 126 to the convergence chamber 127*a*, and then temporarily stored in the first chamber 127*b* through the central aperture 1220 of the resonance plate 122. When the piezoelectric actuator 123 is driven to discharge the air, the air is transferred from the first chamber 127*b* to the convergence chamber 127*a* through the central aperture 1220 of the resonance plate 122, and introduced into the air bag layer 1123 (shown in FIG. 2).

Figure 7A:
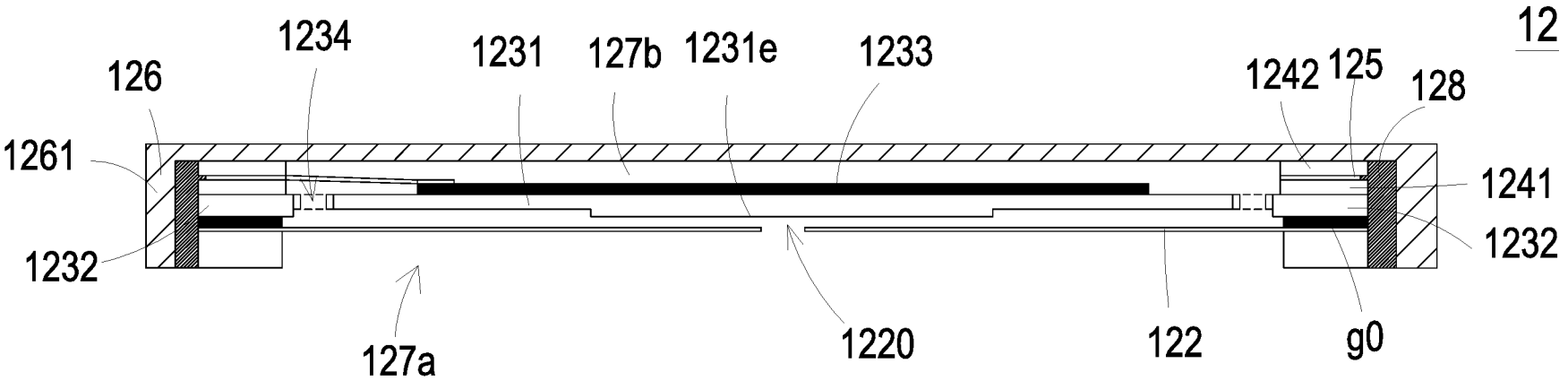
FIGS. 7A to 7D illustrate an operating process of the air pump according to an embodiment of the present disclosure.

The operating process of the air pump 12 is further described in the following. Please refer to FIGS. 7A to 7D. FIGS. 7A to 7D illustrate an operating process of the air pump according to an embodiment of the present disclosure. Firstly, as shown in FIG. 7A, the structure of the air pump 12 is similar to that in the foregoing descriptions and assembled and stacked sequentially by the order of the cover plate 126, the second insulation plate 1242, the conducting plate 125, the first insulation plate 1241, the piezoelectric actuator 123 and the resonance plate 122. There is a gap g0 formed between the resonance plate 122 and the piezoelectric actuator 123. Moreover, the resonance plate 122 and the sidewalls 1261 of the cover plate 126 collaboratively define the convergence chamber 127*a*. The first chamber 127*b* is formed between the resonance plate 122 and the piezoelectric actuator 123 spaced apart by the gap g0. When the air pump 12 has not been driven by a voltage, the positions of the components are illustrated in FIG. 7A.

Figure 7B:
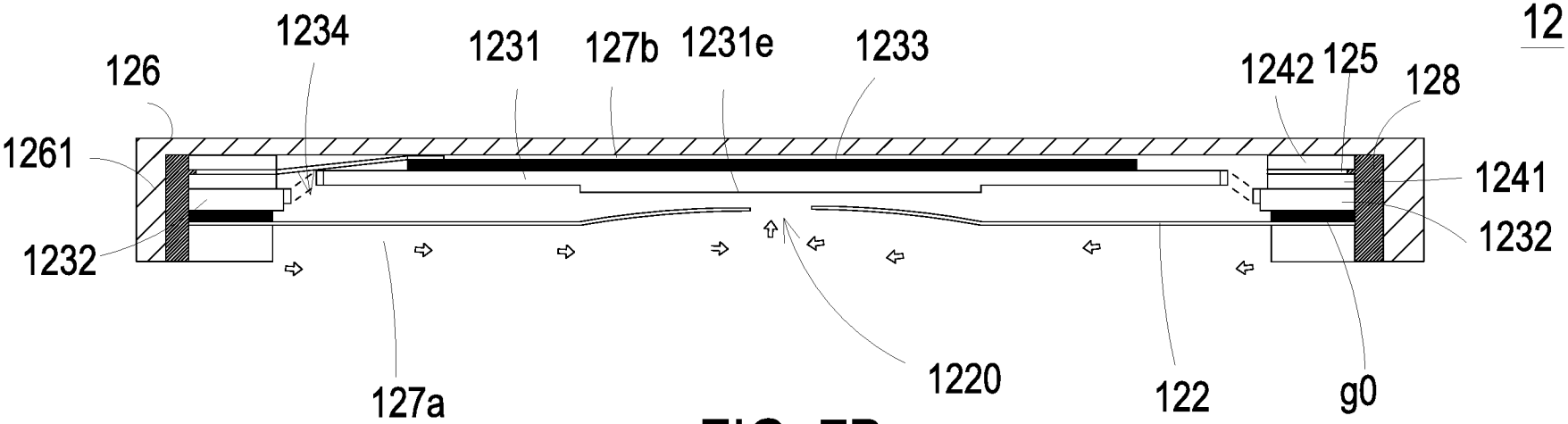

Further as shown in FIG. 7B, when the piezoelectric actuator 123 of the first pump 12 is driven by a voltage and vibrates upwardly, the air is introduced from the opening portion 1263 of the cover plate 126 into the air pump 12 and converges to the convergence chamber 127*a*, and then flows into the first chamber 127*b* through the central aperture 1220 of the resonance plate 122. Simultaneously, the resonance plate 122 is influenced by the resonance of the suspension plate 1231 of the piezoelectric actuator 123 to generate a reciprocating vibration. Namely, the resonance plate 122 is deformed upwardly. The resonance plate 122 protrudes slightly at central aperture 1220.

Figure 7C:
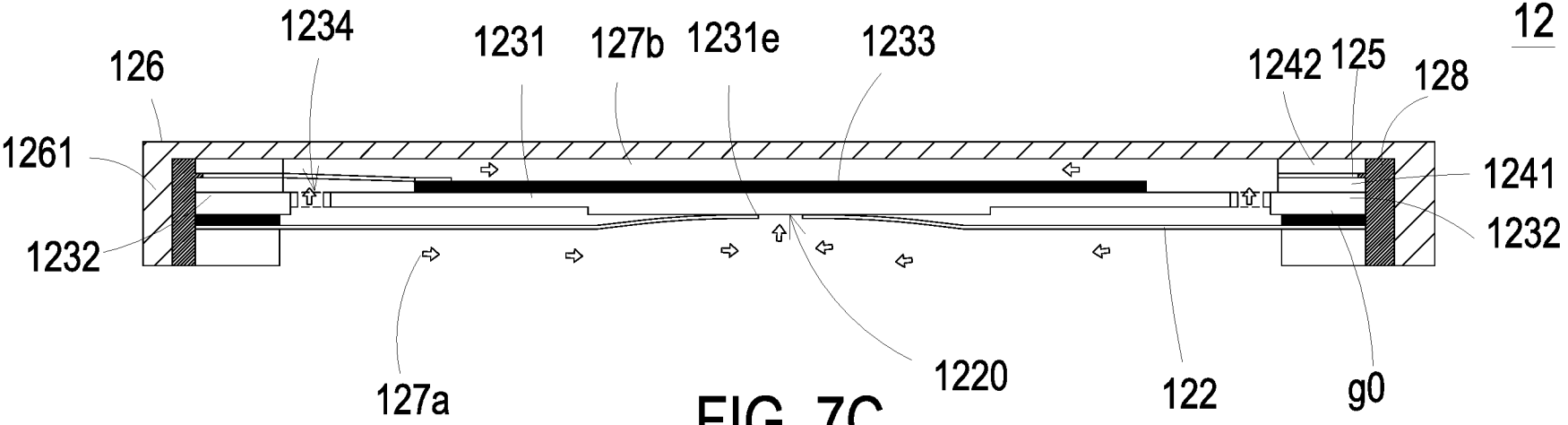

Afterward, as shown in FIG. 7C, the piezoelectric actuator 123 vibrates downwardly to the original position. Meanwhile, the bulge 1231*e* of the suspension plate 1231 of the piezoelectric actuator 123 is close to the upward protruded portion of the resonance plate 122 at the central aperture 1220. It makes the air in the air pump 12 temporarily stored in the upper half layer of the first chamber 127*b*.

Figure 7D:
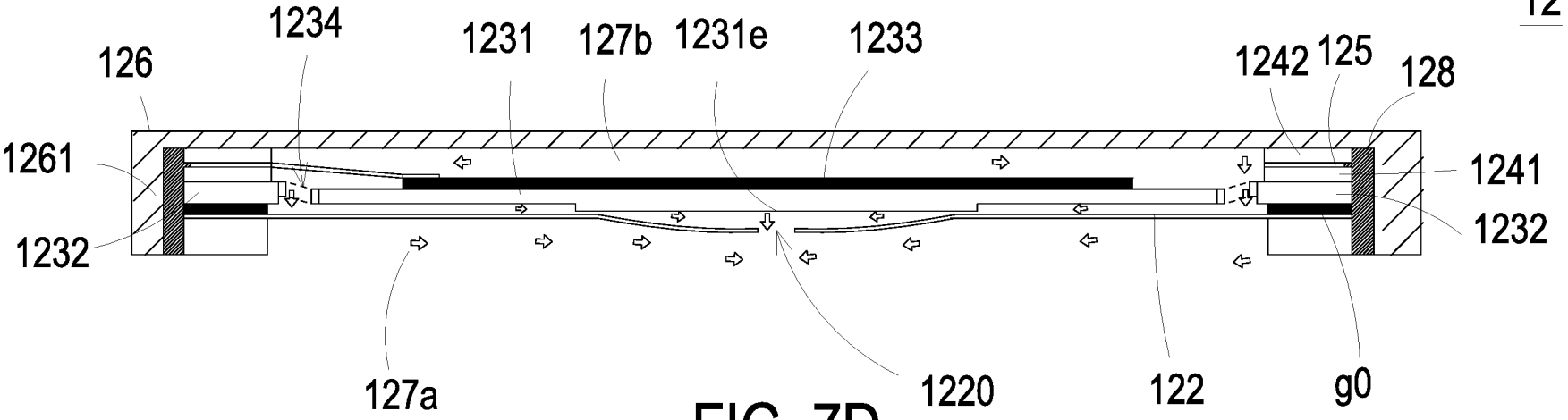

As shown in FIG. 7D, the piezoelectric actuator 123 further vibrates downwardly and the resonance plate 122 also vibrates downwardly due to the resonance of the piezoelectric actuator 123. With the downward deformation of the resonance plate 122 to shrink the volume of the first chamber 127*b*, the air in the upper half layer of the first chamber 127*b* is pushed to flow toward the both sides and pass through the interspace 1234 of the piezoelectric actuator 123 downwardly, so as to be transferred to the central aperture 1220 of the resonance plate 122 and compressed to discharge. Thus, a compressed air is formed to flow into the airflow channel 1123*a* (shown in FIG. 2), which is connected with the air pump 12. With the visible aspect of this embodiment, when the resonance plate 122 performs the vertical reciprocating vibration, the gap g0 between the resonance plate 122 and the piezoelectric actuator 123 facilitates to increase the maximum distance in the vertical displacement. In other words, the gap g0 disposed between the resonance plate 122 and the piezoelectric actuator 123 allows the resonance plate 122 to generate a greater amplitude of the up and down displacement when it is in resonance.

Finally, the resonance plate 122 returns to the original position as shown in FIG. 7A. With the above described operating process, the circulation in the order of FIGS. 7A to 7D is maintained continuously. The air is fed from the opening portion 1263 of the cover plate 126 into the convergence chamber 127*a* and then flows to the first chamber 127*b*. Afterward, the air is further transferred from the first chamber 127*b* to the convergence chamber 127*a*, so that the air flows into the air bag layer 1123 (shown in FIG. 2) continuously to inflate the air bag layer 1123.

In summary, the present disclosure provides an intelligent bra including an air pump collaborating with the air bag layer of the cup set, in which the air pump is controlled to inflate or deflate the air bag layer of the cup set to adjust the inner pressure thereof. In this way, the hardness, the appearance and the support strength of the first cup and the second cup can be arbitrarily adjustable according to the breasts shape of each user to achieve the effects of supporting stably and pushing up. Since the intelligent bra of the present disclosure is adjustable to fit the breasts of each user, the present disclosure has significant improvement in providing optimal wearing experience of a bra.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. An intelligent bra comprising:

a main body comprising:

a connection base;

a cup set comprising a first cup and a second cup disposed symmetrically with respect to a central part therebetween, the cup set being connected with the connection base and further comprising an outer layer, an inner layer and an air bag layer disposed between the outer layer and the inner layer to be covered thereby, wherein the air bag layer comprises an airflow channel having a connection end connected to the center part;

two back bands each of which has a connecting portion and an end portion, wherein the connecting portions of the back bands are connected with two lateral sides of the connection base, respectively; and two fixing elements disposed on the end portions of the two back bands, respectively; and an air pump connected with the connection end of the airflow channel of the air bag layer and configured to inflate or deflate the air bag layer such that an inner pressure of the air bag layer is adjusted, wherein the air pump comprises:

a resonance plate comprising a central aperture and a movable part disposed around the central aperture;

a piezoelectric actuator spatially corresponding to the resonance plate; and a cover plate comprising at least one sidewall, a bottom plate and an opening portion, wherein the at least one sidewall protrudes vertically from a periphery of the bottom plate and an accommodation space is collaboratively formed by the bottom plate and the at least one sidewall, wherein a chamber is formed between the resonance plate and the piezoelectric actuator spaced apart by a gap, wherein while the piezoelectric actuator is enabled, the air is introduced into the opening portion of the cover plate and transferred to the chamber through the central aperture of the resonance plate, so that the movable part of the resonance plate is reciprocated along with the piezoelectric actuator to generate a resonance air flowing.

2. The intelligent bra according to claim 1, wherein the main body further comprises an accommodation part disposed on the connection base and configured to accommodate the air pump while the air pump is detached.

3. The intelligent bra according to claim 1, further comprising two straps, wherein each of the two straps comprises a first end and a second end, the first ends of the two straps are connected to top edges of the first cup and the second cup, respectively, and the second ends of the two straps are connected to the two back bands, respectively.

4. The intelligent bra according to claim 1, wherein the inner layer of the main body further comprises plural protrusions disposed between the first cup and the second cup, and the plural protrusions are connected with the air bag layer.

5. The intelligent bra according to claim 1, wherein the piezoelectric actuator comprises:

a suspension plate having a first surface and an opposing second surface, wherein the suspension plate is permitted to undergo a bending vibration;

an outer frame arranged outside around the suspension plate;

at least one bracket connected between the suspension plate and the outer frame for elastically supporting the suspension plate; and a piezoelectric element, wherein a length of a side of the piezoelectric element is smaller than or equal to a length of a side of the suspension plate, and the piezoelectric element is attached on the first surface of the suspension plate, wherein when a voltage is applied to the piezoelectric element, the suspension plate is driven to undergo the bending vibration.

6. The intelligent bra according to claim 5, wherein the suspension plate is a square suspension plate with a bulge.

7. The intelligent bra according to claim 1, wherein the air pump further comprises a conducting plate, a first insulation plate and a second insulation plate, wherein the resonance plate, the piezoelectric actuator, the first insulation plate, the conducting plate, the second insulation plate and the cover plate are stacked sequentially.

8. An intelligent bra comprising:

at least one main body comprising:

at least one connection base;

at least one cup set comprising at least one first cup and at least one second cup disposed symmetrically with respect to at least one central part therebetween, the cup set being connected with the connection base and further comprising at least one outer layer, at least one inner layer and at least one air bag layer disposed between the outer layer and the inner layer to be covered thereby, wherein the air bag layer comprises at least one airflow channel having at least one connection end connected to the center part;

two back bands each of which has a connecting portion and an end portion, wherein the connecting portions of the back bands are connected with two lateral sides of the connection base, respectively; and two fixing elements disposed on the end portions of the two back bands, respectively; and at least one air pump connected with the connection end of the airflow channel of the air bag layer and configured to inflate or deflate the air bag layer such that an inner pressure of the air bag layer is adjusted, wherein the air pump comprises:

a resonance plate comprising a central aperture and a movable part disposed around the central aperture;

a piezoelectric actuator spatially corresponding to the resonance plate; and a cover plate comprising at least one sidewall, a bottom plate and an opening portion, wherein the at least one sidewall protrudes vertically from a periphery of the bottom plate and an accommodation space is collaboratively formed by the bottom plate and the at least one sidewall, wherein a chamber is formed between the resonance plate and the piezoelectric actuator spaced apart by a gap, wherein while the piezoelectric actuator is enabled, the air is introduced into the opening portion of the cover plate and transferred to the chamber through the central aperture of the resonance plate, so that the movable part of the resonance plate is reciprocated along with the piezoelectric actuator to generate a resonance air flowing.

* * * * *